US008322646B2

(12) United States Patent
Ueyama et al.

(10) Patent No.: US 8,322,646 B2
(45) Date of Patent: Dec. 4, 2012

(54) WINDER

(75) Inventors: Minoru Ueyama, Katano (JP); Masayu Takagi, Daito (JP); Kenshin Kawamura, Osaka (JP)

(73) Assignee: Fuji Tekko Co., Ltd., Katano-shi, Osaka (JP)

( * ) Notice: Subject to any disclaimer, the term of this patent is extended or adjusted under 35 U.S.C. 154(b) by 358 days.

(21) Appl. No.: 12/735,649

(22) PCT Filed: Apr. 1, 2009

(86) PCT No.: PCT/JP2009/056798

§ 371 (c)(1),
(2), (4) Date: Aug. 4, 2010

(87) PCT Pub. No.: WO2009/125698

PCT Pub. Date: Oct. 15, 2009

(65) Prior Publication Data

US 2010/0320308 A1 Dec. 23, 2010

(30) Foreign Application Priority Data

Apr. 11, 2008 (JP) ..... 2008-103233

(51) Int. Cl.
*B65H 19/22* (2006.01)

(52) U.S. Cl. ..... 242/533; 242/559; 242/559.4

(58) Field of Classification Search ..... 242/533, 242/533.1, 559, 559.3, 559.4
See application file for complete search history.

(56) References Cited

U.S. PATENT DOCUMENTS 4,055,313 A * 10/1977 Yamaguchi et al. ..... 242/530.4
5,205,505 A * 4/1993 Focke et al. ..... 242/559.3
5,620,151 A * 4/1997 Ueyama et al. ..... 242/530
6,260,786 B1 7/2001 Ueyama
6,533,212 B1 * 3/2003 Tafel, II ..... 242/554.6

FOREIGN PATENT DOCUMENTS

JP 60-031459 2/1985
JP 2001-163488 6/2001
JP 2001-220037 8/2001

OTHER PUBLICATIONS

International Search Report dated May 12, 2009 (4 pages).

* cited by examiner

*Primary Examiner* — Sang Kim
(74) *Attorney, Agent, or Firm* — Flynn, Thiel, Boutell & Tanis, P.C.

(57) ABSTRACT

A front winding base frame (1A) and a rear winding base frame (1B) are respectively provided with winding arms (3A and 3B) that hold winding shafts (4A and 4B) so as to be capable of ascending and descending vertically, and the winding arms (3A and 3B) are attached to the front winding base frame (1A) and the rear winding base frame (1B) so as to be capable of being exchanged between the front winding base frame (1A) and the rear winding base frame (1B). A front-side touch roller frame (13A) and a rear-side touch roller frame (13B) are respectively provided with touch rollers (16A and 16B) so as to be capable of ascending and descending vertically, and the touch rollers (16A and 16B) are attached to the front-side touch roller frame (13A) and the rear-side touch roller frame (13B) so as to be capable of being exchanged between the front-side touch roller frame (13A) and the rear-side touch roller frame (13B). In this winder, the winding shaft (4A or 4B) while being in pressure contact with the touch roller (16A) is passed on from the front winding base frame (1A) to the rear winding base frame (1B).

3 Claims, 7 Drawing Sheets

WINDER

TECHNICAL FIELD

The present invention relates to a winding machine that winds various webs, and in particular to a winding machine that does not require the use of a turret lathe and that is configured to be capable of changing a shaft by eliminating a loss in a web or the like during a shaft change.

BACKGROUND ART

A web or the like fed from a process in which the web is manufactured (pre-process) is wound around a roll core by a winding machine, and when a predetermined length is wound, the finished roll core is changed to the next new roll core. Here, with a conventional technique, usually, the fully wound winding shaft and the new roll core are installed in a two-shaft turret lathe or a multi-shaft turret lathe, and the turret lathe is rotated each time there is a changed to a new roll core. When the fully wound winding shaft comes to a removal position and the new roll core comes to a winding position, a cutting blade is moved down to cut the web running between the winding shaft and the new roll core, then, the cut-off end of the running web is wound around the new roll core and a fully wound roll formed around the fully wound winding shaft is removed.

However, in the case of winding in which a shaft change is performed using such a turret lathe, because the size of the turret lathe is determined by the distance between the centers of the winding shafts according to the winding diameter, the size of the turret lathe increases as the winding diameter increases. Consequently, the machine has to become bigger with increasing winding diameter, which inevitably increases the manufacturing cost significantly. In addition, as the distance between winding shafts increases, the path length of the web during a shaft change increases, causing neck-in or wrinkles in the case of a particularly easy-to-stretch film or the like. Furthermore, when the distance between winding shafts is large, the traveling distance of a roll core through rotation of the turret lathe during a shaft change is large, so it is difficult to achieve a short cycle of shaft changes.

In terms of power transmission, in the turret-lathe type, because the winding shafts are within the turret lathe, it is necessary to install winding motors outside the winding arm in a number equal to the number of shafts so as to transmit power to the winding shafts via the primary shaft portion of the rotating turret lathe. As a result, a large-sized power transmitting apparatus is required, and a large mechanical loss of rotation occurs, causing a considerable problem of controlling the transmission torque necessary for the winding shafts.

Under the circumstances, in order to resolve the problems encountered with the above-described conventional turret-lathe-type winding machine, the present applicant focused on a type of winding machine that is different from the turret lathe type, and found and proposed a linear-motion-type winding machine in which the shafts independently move in a forward direction and a rearward direction and in an up direction and a down direction in an area in which they do not interfere with each other (see, for example, Patent Document 1).

This winding machine does not use a turret lathe, and is configured such that winding shaft holding parts are provided independently so as to be positioned in forward and back positions and upper and lower positions, and the two winding shafts are moved straightforwardly in an area that they do not interfere with each other in a forward direction and a rearward direction and in an up direction and a down direction; and, thereby, a continuously fed web can be cut, and the shaft around which the web is wound can be changed to a new shaft. This winding machine is provided with a first touch roller that allows a web fed to the vicinity of a winding position to be wound around a winding shaft with the first touch roller being in pressure contact, and a second touch roller that is moved while being in pressure contact with a fully wound roll at the winding position when moving the roll.

PRIOR ART DOCUMENT

Patent Document

[Patent Document 1] Japanese Patent No. 3052086

SUMMARY OF INVENTION

Problem to be Solved by the Invention

However, in the above-described winding machine of Patent Document 1, the first touch roller is brought into pressure contact with the web and winding is performed, the second touch roller is moved while being in pressure contact with the fully wound roll, and take over of the winding shaft is performed between the first touch roller and the second touch roller, that is, a new shaft side and a fully wound shaft side. Accordingly, there are problems in that when the roll is fully wound roll and take over is performed between the first touch roller and the second touch roller, wrinkling and neck-in occur, causing a loss in the web.

In order to cope with the above-described problems, the present invention has been accomplished by placing focus on the elimination of the take-over from one touch roller by another touch roller and the prevention of a loss in a web, based on a finding that one touch roller is kept in pressure contact from the start of winding to the end of winding. It is an object of the present invention to eliminate the use of a turret lathe, prevent the occurrence of wrinkling and neck-in during shaft changes, and achieve winding and shaft changing for a web of superior quality.

Means for Solving the Problems

In order to achieve the above object, a winder that winds a web according to the present invention is winder including: a front winding base frame and a rear winding base frame that are arranged oppositely with a prescribed spacing therebetween and that move in a forward direction and a rearward direction, wherein winding arms that hold a winding shaft are attached to the front winding base frame and the rear winding base frame, respectively, so as to be capable of ascending and descending vertically, the winding arms are detachably attached so as to be capable of being exchanged between the front winding base frame and the rear winding base frame without interfering with each other, a front-side touch roller frame and a rear-side touch roller frame that correspond to the front winding base frame and the rear winding base frame, respectively, are provided under the front winding base frame and the rear winding base frame, the front-side touch roller frame that corresponds to the front winding base frame is fixed, and the rear-side touch roller frame that corresponds to the rear winding base frame is disposed so as to be capable of slidingly moving in a forward direction and a rearward direction, a touch roller is attached to each of the front-side touch roller frame and the rear-side touch roller frame so as to be capable of ascending and descending vertically, the touch rollers are detachably attached so as to be capable of being exchanged between the front-side touch roller frame and the rear-side touch roller frame without interfering with each other, and the winding shaft of the winding arm attached to the front winding base frame is passed on to the rear winding base frame while the touch roller attached to the front-side touch roller frame is in pressure contact with the winding shaft.

Also, in order to achieve the above object, a winder that winds a web according to the present invention is a winder including: a front winding base frame and a rear winding base frame that are arranged oppositely with a prescribed spacing therebetween and that move in a forward direction and a rearward direction, wherein winding arms that hold a winding shaft are attached to the front winding base frame and the rear winding base frame, respectively, so as to be capable of ascending and descending vertically, the two winding arms are detachably attached so as to be capable of being exchanged between the front winding base frame and the rear winding base frame without interfering with each other, a front-side touch roller frame and a rear-side touch roller frame that correspond to the front winding base frame and the rear winding base frame, respectively, are provided under the front winding base frame and the rear winding base frame, the front-side touch roller frame that corresponds to the front winding base frame is fixed, and the rear-side touch roller frame that corresponds to the rear winding base frame is disposed so as to be capable of slidingly moving in a forward direction and a rearward direction, a touch roller is attached to each of the front-side touch roller frame and the rear-side touch roller frame so as to be capable of ascending and descending vertically, the two touch rollers are detachably attached so as to be capable of being exchanged between the front-side touch roller frame and the rear-side touch roller frame without interfering with each other, the web is wound around the winding shaft of one winding arm that is attached to the front winding base frame while one touch roller that is attached to the front-side touch roller frame is in pressure contact with the winding shaft; after the winding shaft of the one winding arm is fully wound with the web, the winding shaft of the one winding arm around which the web has been fully wound is passed on to the rear winding base frame while the one touch roller is in pressure contact therewith, and the one touch roller is passed on to the rear-side touch roller frame; in turn, the winding shaft that will serve as a new winding shaft of another winding arm attached to the rear winding base frame is passed on to the front winding base frame, and another touch roller attached to the rear-side touch roller frame is passed on to the front-side touch roller frame; the other touch roller is brought into pressure contact with the new winding shaft; and after that, the web is cut between the two winding arms and the web is wound around the new winding shaft.

In the aforementioned configuration, at least either a stopper pin and an engagement hole, or a magnet is used as an attachment/detachment means of the winding arm with respect to the front winding base frame and the rear winding base frame, and an attachment/detachment means of the touch roller with respect to the front-side touch roller frame and the rear-side touch roller frame.

Effects of the Invention

According to the present invention, it becomes possible to eliminate the take-over from one touch roller by another touch roller during a shaft change and prevent a loss in a web. Specifically, according to the present invention, because one touch roller that is in pressure contact with a roll can be used from the start to end of winding, it becomes possible to eliminate the use of a turret lathe, prevent the occurrence of wrinkling and neck-in during a shaft change, and achieve winding and shaft changing for a web of superior quality.

Specifically, according to the above-described winder of the present invention, when the end of the web is wound around a new winding shaft by exchanging the winding arms between the front and rear winding base frames by moving the two base frames back and forth, and also by exchanging the touch rollers between two touch roller frames, one winding shaft in pressure contact, that is, the same touch roller is used throughout the full winding of the web, the cutting of the web, the winding of the end of the web around a new winding shaft and the next shaft change, and in turn, another touch roller is brought into pressure contact with a new winding shaft after a shaft change. That is to say, in the present invention, the operation performed between the completion of winding and the changing of a shaft to another shaft is performed by using the same touch roller, as a result of which, because the take-over from one touch roller by another touch roller is not performed, it is possible to prevent the occurrence of wrinkling and neck-in in the web that are caused by such a take-over from one touch roller by another touch roller and to eliminate a loss in the web during a shaft change. In contrast, according to the previous proposal described above, after the end of a web is wound with a touch roller for winding at the start of winding, winding of the web is taken over to another winding touch roller and shaft changing is performed while the other winding touch roller is in contact (the take-over performed between a new shaft side and a fully wound shaft side), so it does not have the effects of the present invention.

DESCRIPTION OF REFERENCE NUMERALS

R Fully Wound Roll
F1, F2 Side Frames on Both Sides
1A Front Winding Base Frame
1B Rear Winding Base Frame
2A, 2B Guide Provided on Each Top Surface
3A, 3B Winding Arm
4A, 4B Winding Shaft:
5*a*, 5*b*, 6*a*, 6*b* Winding-arm-lifting apparatus

7, 8 Stopper Pin
9, 10 Engagement Hole
11, 12 Magnet
13A, 13B Touch Roller Frame
14 Guide Rail
15A, 15B Holder
16A, 16B Touch Roller
17, 18 Lifting Apparatus
19, 20 Stopper Pin
21, 22 Engagement Hole
23, 24 Magnet
25 Cutting Blade
26 Product Transport Apparatus
28 to 33 Guide Roller

MODE FOR CARRYING OUT THE INVENTION

Hereinafter, a specific embodiment of a winder (a two-shaft lossless winder) according to the present invention will be described in detail with reference to the accompanying drawings.

Figure 1:
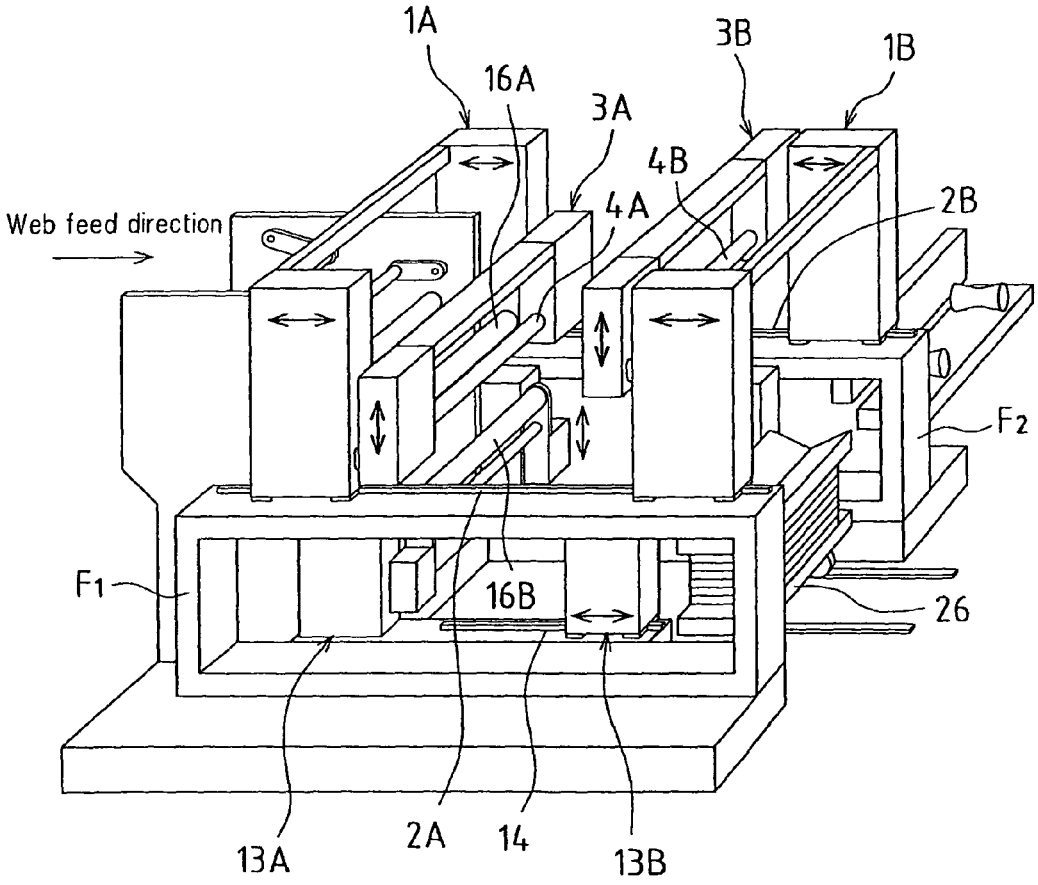
FIG. 1 is a perspective exterior view of a winder according to an embodiment of the present invention.
Figure 2:
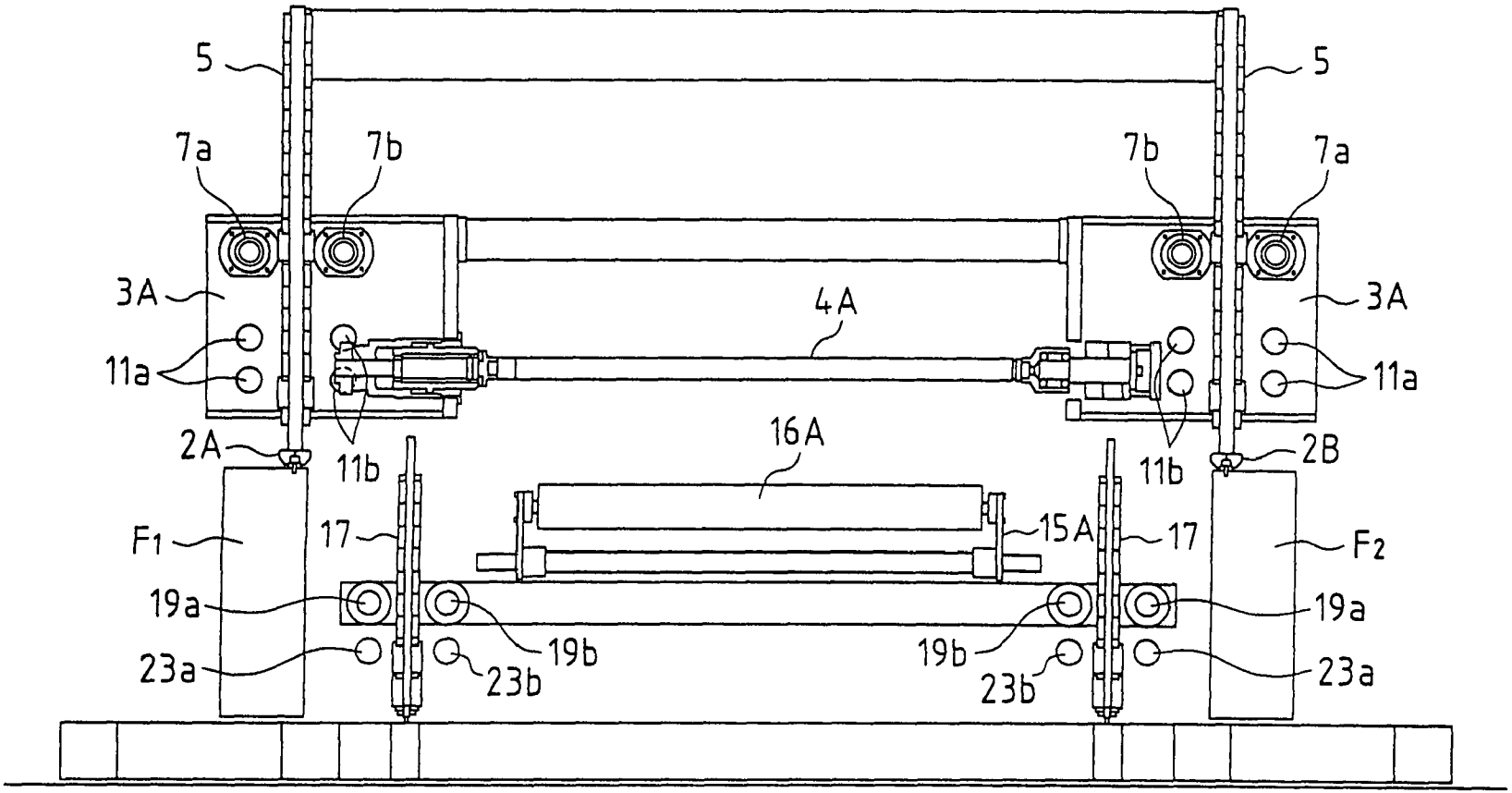
FIG. 2 is a front view of the winder according to an embodiment of the present invention.
Figure 3:
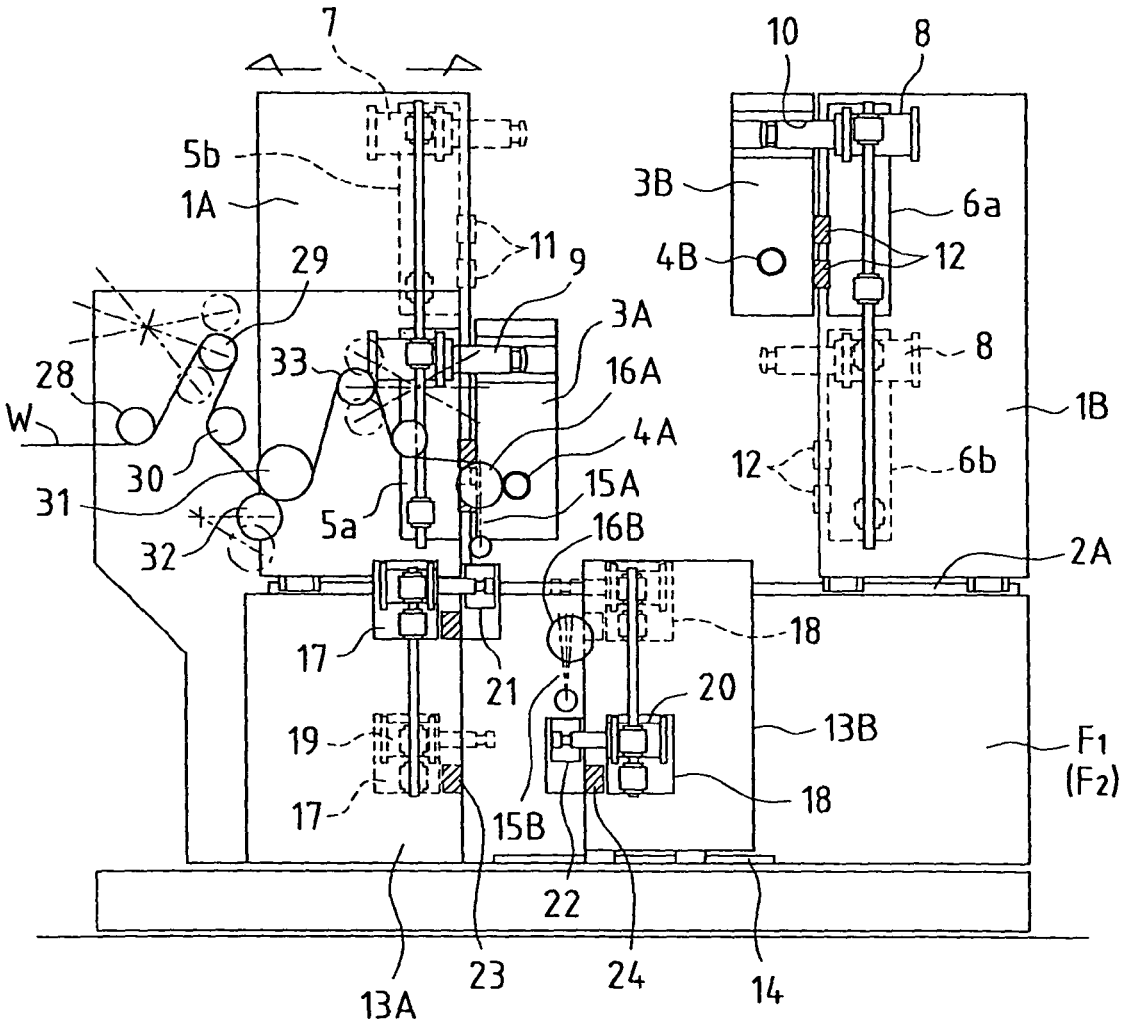
FIG. 3 is a side view of the winder according to an embodiment of the present invention, showing the states at the start of winding and in the middle of winding.
Figure 4:
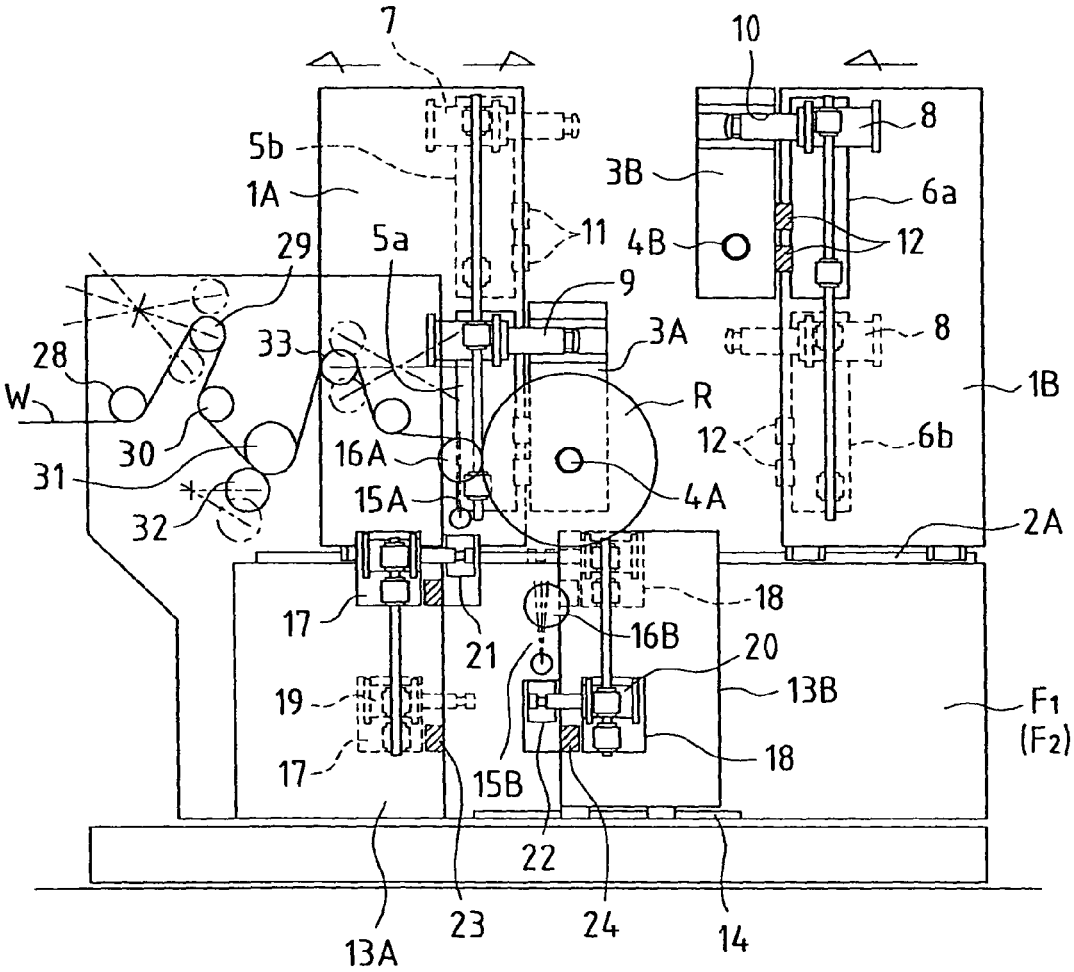
FIG. 4 is a side view of the winder according to an embodiment of the present invention, showing a fully wound state before a shaft-changing cycle.
Figure 5:
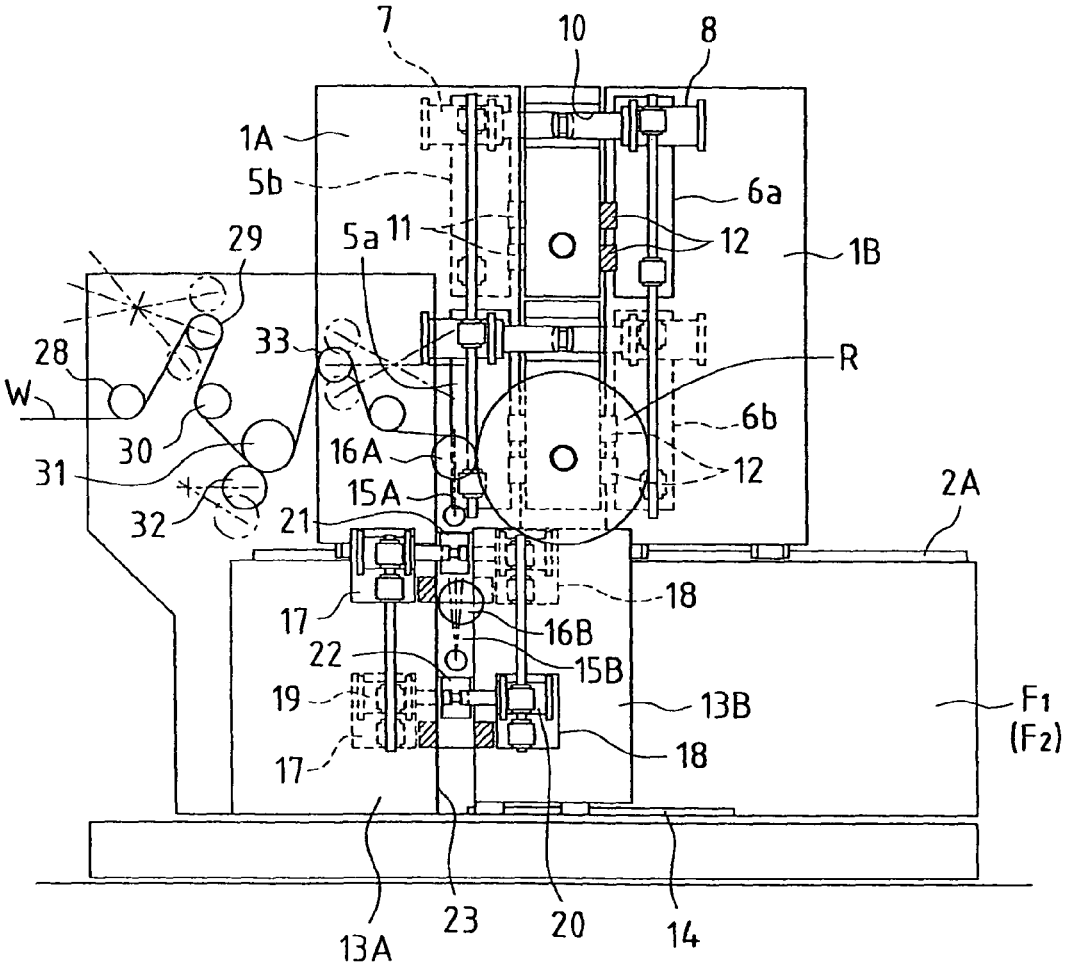
FIG. 5 is a side view of the winder according to an embodiment of the present invention, showing a take-over state during a shaft change.

FIG. 1 is an exterior perspective view of a winder according to an embodiment of the present invention. FIG. 2 is a front view of the winder according to an embodiment of the present invention. FIG. 3 is a side view of the winder according to an embodiment of the present invention, showing the start of winding. FIG. 4 is a side view of the winder according to an embodiment of the present invention, showing a fully wound state before a shaft-changing cycle. FIG. 5 a side view showing a take-over state during a shaft change according to an embodiment of the present invention.

In these diagrams (FIGS. 1 to 5), reference numeral 1A denotes a front winding base frame, and reference numeral 1B denotes a rear winding base frame. The front winding base frame 1A and the rear winding base frame 1B are capable of moving in a forward direction and a rearward direction (e.g., a lateral direction in the plane of FIG. 1) along guides 2A and 2B that are provided respectively on the top surfaces of side frames F1 and F2 on both sides.

The winder according to the present embodiment is provided with winding arms 3A and 3B that respectively hold winding shafts 4A and 4B around which a web is wound. As shown in FIGS. 2 to 5, the winding arms 3A and 3B are provided so as to be capable of ascending and descending vertically by means of winding-arm-lifting apparatuses (hereinafter referred to as lifting apparatuses) 5*a*, 5*b* and 6*a*, 6*b* that are respectively provided on both sides in the front winding base frame 1A and the rear winding base frame 1B.

In addition, in the front winding base frame 1A and the rear winding base frame 1B, stopper pins 7 and 8 are attached to the sides sandwiching the lifting apparatuses 5*a*, 5*b* and 6*a*, 6*b*, and engagement holes 9 and 10 that correspond to the stopper pins 7 and 8 are formed in the winding arms 3A and 3B, so that the winding arms 3A and 3B can be attached and detached by engaging and disengaging the stopper pins 7 and 8 with and from the engagement holes 9 and 10 (attachment/detachment means of the winding arm with respect to the front and rear winding base frames as set forth in the present invention).

Furthermore, similar to the engagement holes 9 and 10, the lifting apparatuses 5*a*, 5*b* and 6*a*, 6*b* are provided with magnets 11 and 12 (attachment/detachment means of the winding arm with respect to the front and rear winding base frames as set forth in the present invention).

The winding arms 3A and 3B can be attached and detached to and from the front winding base frame 1A and the rear winding base frame 1B by the engagement and disengagement (attachment and detachment) of the stopper pins 7 and 8 and the magnets 11 and 12, so that the winding arms 3A and 3B can be exchanged for each other as appropriate.

In the present embodiment, as shown in the diagrams, a configuration is adopted in which the attachment and detachment of the winding arms 3A and 3B are performed through a combined use of the engagement and disengagement of the stopper pins 7 and 8 with and from the engagement holes 9 and 10 and the attachment and detachment of the magnets 11 and 12 so as to exchange the winding arms 3A and 3B, but the configuration is not necessarily limited thereto, and other attachment/detachment means may be used.

Reference numerals 13A and 13B denote touch roller frames that are installed under the front winding base frame 1A and the rear winding base frame 1B, that is, under the winder so as to correspond to the front winding base frame 1A and the rear winding base frame 1B, respectively. Usually, as shown in FIGS. 3 to 5, the touch roller frame 13A on the front side is fixed, and the touch roller frame 13B on the rear side is configured so as to be capable of slidingly moving in a forward direction and a rearward direction along a guide rail 14 in the winder. The touch roller frames 13A and 13B have holders 15A and 15B for holding touch rollers 16A and 16B, respectively, that are configured so as to be capable of ascending and descending vertically together with the touch rollers 16A and 16B by means of lifting apparatuses 17 and 18 as with the winding arms 3A and 3B as shown in FIG. 2. Furthermore, the touch roller frames 13A and 13B are configured such that the touch roller holders 15A and 15B are capable of being attached and detached by the engagement and disengagement (attachment and detachment) of stopper pins 19 and 20 with and from engagement holes 21 and 22 and the attachment and detachment of magnets 23 and 24 (attachment/detachment means of the touch roller with respect to the front-side touch roller frame and the rear-side touch roller frame as set forth in the present invention), so that the touch roller holders 15A and 15B can be exchanged.

In the above-described configuration, as stated above, the winding arms 3A and 3B are capable of being attached and detached to and from the front winding base frame 1A and the rear winding base frame 1B so that the winding arms 3A and 3B can be exchanged, and the touch roller holders 15A and 15B are capable of being attached and detached to and from the touch roller frames 13A and 13B so that the touch roller holders 15A and 15B can be exchanged, but when these members are detached so as to be exchanged, it is important to adopt an arrangement that does not allow these members to interfere with each other.

The winder according to an embodiment of the present invention is configured as described above, and a web W fed from a pre-process passes through a plurality of guide rollers 28, 29, 30, 31, 32 and 33 to a winding position. The web W fed to the winding position is sequentially wound around the winding shaft 4A held by the winding arm 3A with the touch roller 16A being in pressure contact at the winding position. At this time, the holder 15A of the fixed touch roller frame 13A is positioned at the winding position, and the touch roller 16A is brought into pressure contact with the winding shaft 4A at the winding position.

Meanwhile, the winding arm 3B in which winding of the web W is not performed is on standby at a standby position together with the rear winding base frame 1B, without interrupting the winding around the winding shaft 4A of the winding arm 3A (see FIG. 3).

Then, the winding of the web W around the winding shaft 4A of the winding arm 3A proceeds, and when a wound roll R around the winding shaft 4A comes to being fully or nearly fully wound as shown in FIG. 4, the winding shaft is changed to a new one (a shaft changing step). In the shaft changing step, the front winding base frame 1A moves in a rearward direction so as to be close to the rear winding base frame 1B, the rear base frame 1B moves in a forward direction, and the touch roller frame 13B below moves in the forward direction, whereby preparation for shaft changing is performed. At this time, the front touch roller 16A is still in pressure contact with the fully wound roll R around the winding shaft 4A. When the preparation for shaft changing ends, as shown in FIG. 5, the rear winding base frame 1B moves closer to the front winding base frame 1A, and then the fully wound roll R of the front winding base frame 1A at the winding position is passed on to the rear winding base frame 1B.

Figure 6:
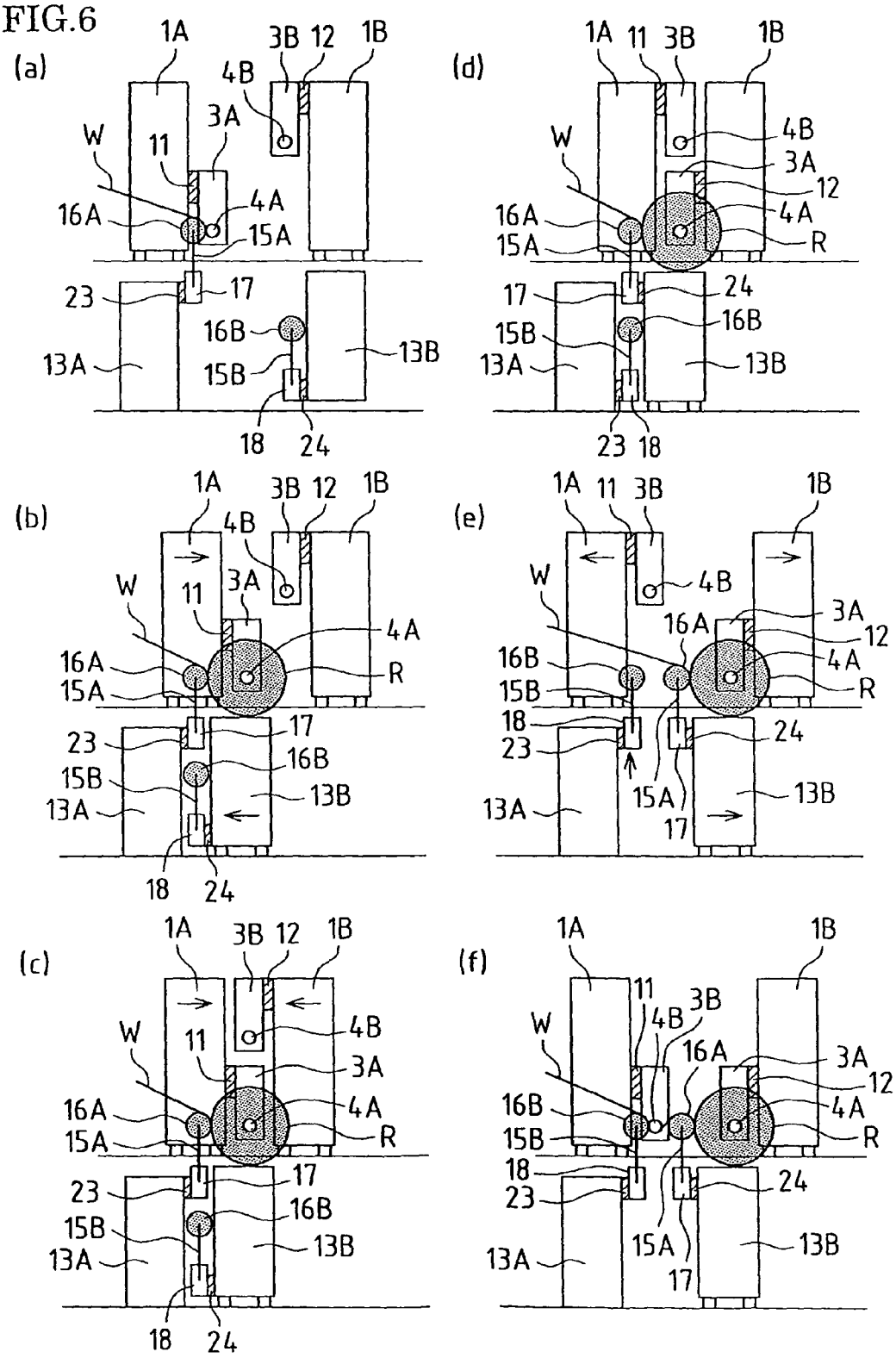
FIG. 6 includes FIGS. 6(*a*) to 6(*f*), which are diagrams of winding steps performed by the winder according to an embodiment of the present invention and show a winding procedure by the winder of the present invention.
Figure 7:
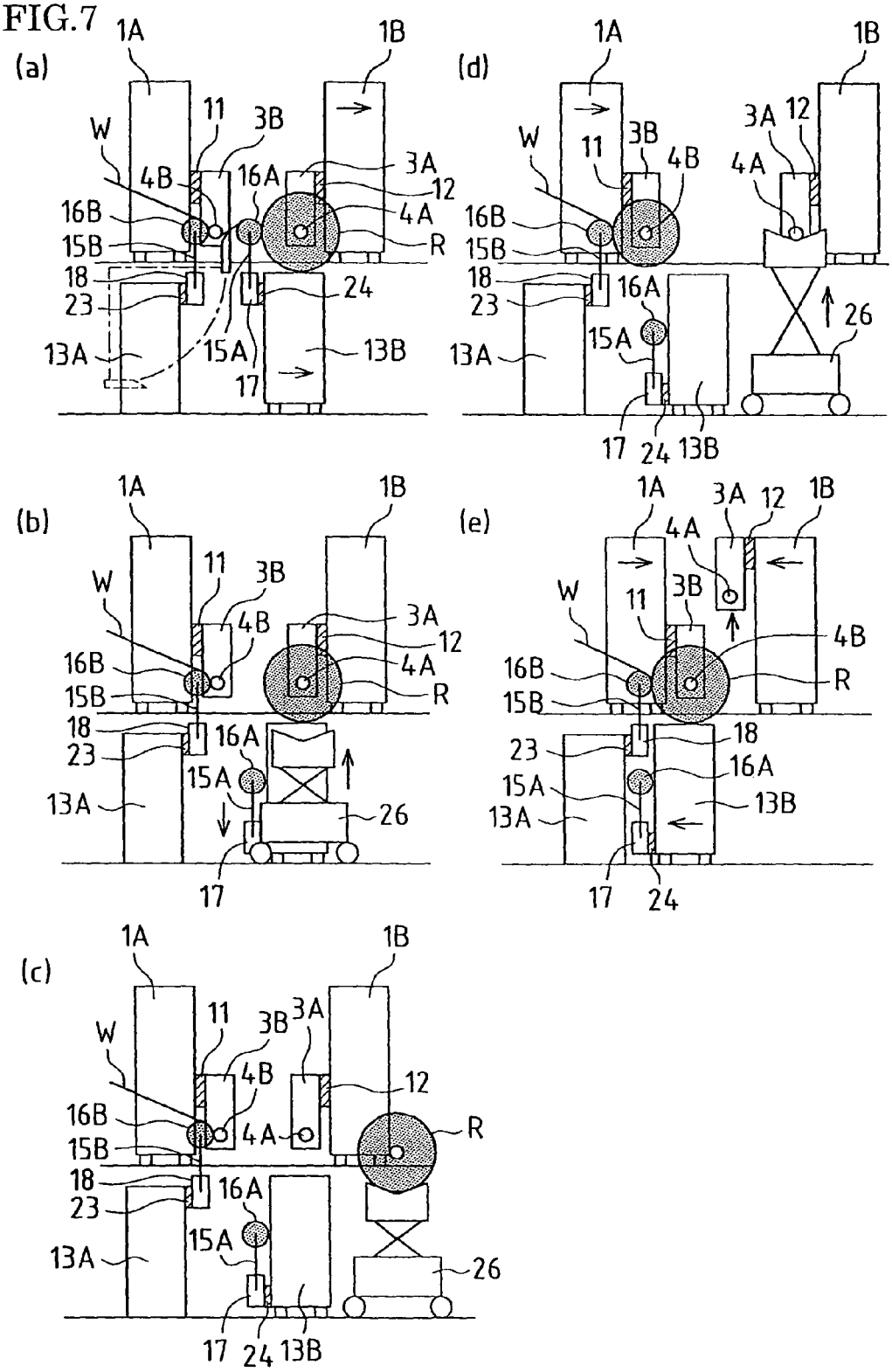
FIG. 7 includes FIGS. 7(*a*) to 7(*e*), which are diagrams of the steps performed after the winding steps of FIG. 6 and show a winding procedure by the winder of the present invention.

The series of steps for winding a web W and changing a shaft performed by the winder according to an embodiment of the present invention including the above steps is specifically performed in accordance with the procedure shown in FIGS. 6 and 7. Referring first to FIG. 6, FIG. 6(*a*) is a diagram showing a schematic configuration of the winder when the winding of a web W is started. As shown in FIG. 6(*a*), when the winding of a web W is started, the front winding base frame 1A and the rear winding base frame 1B, as well as the touch roller frames 13A and 13B below are spaced apart from each other with a prescribed spacing. Here, the winding arm 3A of the front winding base frame 1A is positioned at the winding position and holds the winding shaft 4A, and the touch roller holder 15A of the front touch roller frame 13A is lifted to bring the touch roller 16A into pressure contact with the winding shaft 4A. Then, in this state, winding is started, and a web W fed from a process in which the web W is manufactured (pre-process) is sequentially wound around the winding shaft 4A. In the process for winding the web W around the winding shaft 4A to form a fully wound roll, when it becomes nearly fully wound, as shown in FIG. 6(*b*), the front winding base frame 1A moves in a direction approaching the rear winding base frame 1B, and at the same time, the touch roller frame 13B moves toward the touch roller frame 13A in the forward direction so as to prepare for the winding arms 3A and 3B to be changed.

When a fully wound roll R is formed around the winding shaft 4A, as shown in FIG. 6(*c*), the front winding base frame 1A and the rear winding base frame 1B move closer to each other. At this time, the winding arm 3B of the rear winding base frame 1B is held at an elevated position above the winding arm 3A so as not to interfere with the winding arm 3A of the front winding base frame 1A. Likewise, the touch roller frame 13B on the rear side is positioned close to the touch roller frame 13A on the front side, and the touch rollers 16A and 16B are in a position where they do not interfere with each other. Specifically, the touch roller 16A is positioned in an elevated position above the touch roller 16B.

In this state, as shown in FIG. 6(*d*), the winding arms 3A and 3B are exchanged between the front winding base frame 1A and the rear-side winding base frame 1B. Specifically, the winding arm 3A while holding the fully or nearly fully wound roll (hereinafter referred to simply as the fully wound roll) is attached to the rear-side winding base frame 1B through the disengagement of the stopper pin 7 of the front-side winding base frame 1A from the engagement hole 9 of the winding arm 3A and the engagement of the stopper pin 8 of the rear-side winding base frame 1B with the engagement hole 9 and through the detachment of the winding arm 3A from the magnet 11 and the attachment of the same to the magnet 12. Likewise, the winding arm 3B is attached to the front-side winding base frame 1A through the disengagement of the stopper pin 8 of the rear-side winding base frame 1B from the engagement hole 10 of the winding arm 3B and the engagement of the stopper pin 7 of the front-side winding base frame 1A with the engagement hole 10 and through the detachment of the winding arm 3B from the magnet 12 and the attachment of the same to the magnet 11. In this manner, the winding arms 3A and 3B are exchanged between the front winding base frame 1A and the rear-side winding base frame 1B without interfering with each other.

In the state shown in FIG. 6(*d*), in the touch roller frames 13A and 13B below as well, the touch roller holder 15A attached to the front side touch roller frame 13A is conveyed to the rear-side touch roller frame 13B side together with the touch roller 16A that is in pressure contact with the fully wound roll R, and the touch roller holder 15B on the rear-side touch roller frame 13B side is conveyed to the front side touch roller frame 13A side together with the touch roller 16B. Specifically, the lifting apparatus 17 is attached to the touch roller frame 13B through the disengagement of the stopper pin 19 of the touch roller frame 13A from the engagement hole 21 of the lifting apparatus 17 and the engagement of the stopper pin 20 of the touch roller frame 13B with the engagement hole 21 and through the detachment of the lifting apparatus 17 from the magnet 23 and the attachment of the same to the magnet 24. Likewise, the lifting apparatus 18 is attached to the touch roller frame 13A through the disengagement of the stopper pin 20 of the touch roller frame 13B from the engagement hole 22 of the lifting apparatus 18 and the engagement of the stopper pin 19 of the touch roller frame 13A with the engagement hole 22 and through the detachment of the lifting apparatus 18 from the magnet 24 and the attachment of the same to the magnet 23. In this manner, the lifting apparatuses 17 and 18 are exchanged between the touch roller frames 13A and 13B without interfering with each other.

As described above, after the vertical exchange of the winding arms 3A and 3B between an upper position and a lower position, and the exchange between the touch roller frames 13A and 13B have been performed, as shown in FIG. 6(*e*), the front winding base frame 1A that has received the rear-side winding arm 3B holds the winding arm 3B, whereas the rear winding base frame 1B that has received the front-side winding arm 3A moves the front-side winding arm 3A together with the fully wound roll R rearward. At the same time, the rear-side touch roller frame 13B, while holding the front-side holder 15A received from the front side touch roller frame 13A, moves the touch roller 16A rearward with touch roller 16A being in pressure contact with the fully wound roll R. At this time, the rear-side holder 15B that has been conveyed to the front side touch roller frame 13A, while holding the touch roller 16B, lifts the touch roller 16B to the winding position to prepare for the winding of a next web W.

After the state of FIG. 6(*e*), as shown in FIG. 6W, the front winding base frame 1A to which the winding arm 3B has been attached through the above-described exchange causes the winding arm 3B to descend so as to move the winding shaft 4B that is a new winding shaft to the winding position. At this time, an end of the web W that is continuous from the fully wound roll R already wound is wound around the winding shaft 4B. After the end of the web W that is continuous from the fully wound roll R has been wound around the winding shaft 4B that is a new winding shaft in this manner, the procedure advances to the next winding. Before advancing to the next winding, as shown in FIG. 7(*a*), the web W is cut near the winding shaft 4B, which is the new winding shaft, by a cutting blade 25, and the cut-off end is wound around the winding shaft 4B, which is the new winding shaft. At this time, the rear winding base frame 1B and the touch roller frame 13B move rearward (see FIG. 7(*a*)).

After the above-described series of steps for changing a shaft, the winding of the web W around the winding shaft 4B, which is the new winding shaft, starts in the winding arm 3B of the front winding base frame 1A that has been moved to the front side. On the rear winding base frame 1B side, on the other hand, the fully wound roll R is removed as a product.

With respect to removing it as a product, as shown in FIG. 7(*b*), a product transport apparatus 26 is arranged under the rear winding base frame 1B that has moved to the rear so as not to interfere with the touch roller frame 13B, and the fully wound roll R is passed on to the transport apparatus 26 by a known means. Subsequently, the roll core is pulled out at the position shown in FIG. 7(*c*) by a known means on an air shaft pull-out table (not shown), and then the roll is transported as a product. At this time, the holder 15A that has been moved with the touch roller 16A being in pressure contact with the fully wound roll R and that is attached to the touch roller frame 13B is moved to a descended position together with the touch roller 16A and held at the position.

Then, when the above-described series of steps end, as shown in FIG. 7(*d*), the web is wound around a new winding shaft, that is, the winding shaft 4B of the front winding base frame 1A, during which the rear winding base frame 1B is moved rearward, and a step of attaching a new roll core to the winding shaft of the winding arm 3A from which the product has been removed is performed. As shown in FIG. 7(*e*), the winder returns to the state of FIG. 6(*b*). Through this, the effects by the winder of the present embodiment are achieved.

As described above, the winder of the present embodiment, unlike conventionally techniques, does not require the use of a turret lathe, and is capable of independently changing the winding arms with respect to the front winding base frame and the rear winding base frame. In addition, the need for take-over from one touch roller by another touch roller is eliminated, so the cutting of the web, the winding of the end of the web, the subsequent winding of the web around the winding shaft, and the changing of the shaft to another shaft are all performed by using the same touch roller, that is, the touch roller in pressure contact with the roll, whereby the occurrence of wrinkling caused by take-over from one touch roller by another touch roller as well as the occurrence of neck-in can be prevented, enabling efficient winding.

The present invention may be embodied in various other forms without departing from the gist or essential characteristics thereof. Therefore, the embodiment described above is to be considered in all respects as illustrative and not limiting. The scope of the invention is indicated by the appended claims rather than by the foregoing description, and all modifications or changes that come within the meaning and range of equivalency of the claims are intended to be embraced therein.

This application claims priority on Japanese Patent Application No. 2008-103233 filed in Japan on Apr. 11, 2008, the entire contents of which are incorporated herein by reference.

INDUSTRIAL APPLICABILITY

The present invention is applicable to a winding machine that winds various webs.

The invention claimed is:

1. A winder that winds a web comprising:

a front winding base frame and a rear winding base frame that are arranged oppositely with a prescribed spacing therebetween and that move in a forward direction and a rearward direction, wherein winding arms that hold a winding shaft are attached to the front winding base frame and the rear winding base frame, respectively, so as to be capable of ascending and descending vertically, the winding arms are detachably attached so as to be capable of being exchanged between the front winding base frame and the rear winding base frame without interfering with each other, a front-side touch roller frame and a rear-side touch roller frame that correspond to the front winding base frame and the rear winding base frame, respectively, are provided under the front winding base frame and the rear winding base frame, the front-side touch roller frame that corresponds to the front winding base frame is fixed, and the rear-side touch roller frame that corresponds to the rear winding base frame is disposed so as to be capable of slidingly moving in a forward direction and a rearward direction, a touch roller is attached to each of the front-side touch roller frame and the rear-side touch roller frame so as to be capable of ascending and descending vertically, the touch rollers are detachably attached so as to be capable of being exchanged between the front-side touch roller frame and the rear-side touch roller frame without interfering with each other, and the winding shaft of the winding arm attached to the front winding base frame is passed on to the rear winding base frame while the touch roller attached to the front-side touch roller frame is in pressure contact with the winding shaft.

2. A winder that winds a web comprising;

a front winding base frame and a rear winding base frame that are arranged oppositely with a prescribed spacing therebetween and that move in a forward direction and a rearward direction, wherein winding arms that hold a winding shaft are attached to the front winding base frame and the rear winding base frame, respectively, so as to be capable of ascending and descending vertically, the two winding arms are detachably attached so as to be capable of being exchanged between the front winding base frame and the rear winding base frame without interfering with each other, a front-side touch roller frame and a rear-side touch roller frame that correspond to the front winding base frame and the rear winding base frame, respectively, are provided under the front winding base frame and the rear winding base frame, the front-side touch roller frame that corresponds to the front winding base frame is fixed, and the rear-side touch roller frame that corresponds to the rear winding base frame is disposed so as to be capable of slidingly moving in a forward direction and a rearward direction, a touch roller is attached to each of the front-side touch roller frame and the rear-side touch roller frame so as to be capable of ascending and descending vertically, the two touch rollers are detachably attached so as to be capable of being exchanged between the front-side touch roller frame and the rear-side touch roller frame without interfering with each other, the web is wound around the winding shaft of one winding arm that is attached to the front winding base frame while one touch roller that is attached to the front-side touch roller frame is in pressure contact with the winding shaft; after the winding shaft of the one winding arm is fully wound with the web, the winding shaft of the one winding arm around which the web has been fully wound is passed on to the rear winding base frame while the one touch roller is in pressure contact therewith, and the one touch roller is passed on to the rear-side touch roller frame; in turn, the winding shaft that will serve as a new winding shaft of another winding arm attached to the rear winding base frame is passed on to the front winding base frame, and another touch roller attached to the rear-side touch roller frame is passed on to the front-side touch roller frame; the other touch roller is brought into pressure contact with the new winding shaft; and after that, the web is cut between the two winding arms and the web is wound around the new winding shaft.

3. The winder according to claim 1, wherein at least either a stopper pin and an engagement hole, or a magnet is used as an attachment/detachment means of the winding arm with respect to the front winding base frame and the rear winding base frame, and an attachment/detachment means of the touch roller with respect to the front-side touch roller frame and the rear-side touch roller frame.

* * * * *